US006487996B1

(12) United States Patent
Motz et al.

(10) Patent No.: US 6,487,996 B1
(45) Date of Patent: Dec. 3, 2002

(54) DEVICE FOR ADJUSTING THE ANGLE OF ROTATION OF A CAMSHAFT WITH REGARD TO THE CRANKSHAFT OF A RECIPROCATING INTERNAL COMBUSTION ENGINE

(75) Inventors: Thomas Motz, Herzogenaurach (DE); Jochen Auchter, Aurachtal (DE); Torsten Keller, Herzogenaurach (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/958,863

(22) PCT Filed: Mar. 14, 2000

(86) PCT No.: PCT/EP00/02236

§ 371 (c)(1),
(2), (4) Date: Nov. 7, 2001

(87) PCT Pub. No.: WO00/61921

PCT Pub. Date: Oct. 19, 2000

(30) Foreign Application Priority Data

Apr. 14, 1999 (DE) ..... 199 16 644

(51) Int. Cl.[7] ..... F01L 1/344

(52) U.S. Cl. ..... 123/90.17; 123/90.37; 74/568 R

(58) Field of Search ..... 123/90.15, 90.17, 123/90.31, 90.37; 74/568 R

(56) References Cited

U.S. PATENT DOCUMENTS

| | | | | |
|---|---|---|---|---|
| 1,481,212 A | | 1/1924 | Keller | |
| 3,988,942 A | | 11/1976 | Greiner | |
| 5,799,387 A | | 9/1998 | Neuenschwander et al. | |
| 6,155,220 A | * | 12/2000 | Marriott | 123/90.17 |

FOREIGN PATENT DOCUMENTS

| | | |
|---|---|---|
| DE | 19623818 | 12/1996 |
| EP | 0781899 | 7/1997 |
| WO | 98/42952 | 10/1998 |

* cited by examiner

*Primary Examiner*—Weilun Lo
(74) *Attorney, Agent, or Firm*—Bierman, Muserlian and Lucas

(57) ABSTRACT

A device for the angular adjustment of a camshaft relative to a crankshaft of an internal combustion piston engine, particularly a vane-type adjuster comprising a stator and a rotor arranged coaxially to the stator, vanes of the rotor being pivotable by oil pressure in pressure chambers defined by radial walls of the stator. Fabrication work is reduced compared to stators and rotors made by sinter pressing by the fact that the stator and the rotor are comprised respectively of a stack of stator blanks (2, 2') and a stack of rotor blanks (3, 3'), said blanks are made preferably by punching and are firmly connected to one another.

10 Claims, 3 Drawing Sheets

DEVICE FOR ADJUSTING THE ANGLE OF ROTATION OF A CAMSHAFT WITH REGARD TO THE CRANKSHAFT OF A RECIPROCATING INTERNAL COMBUSTION ENGINE

FIELD OF THE INVENTION

The invention concerns a device for the angular adjustment of a camshaft relative to a crankshaft of an internal combustion piston engine, particularly a vane-type adjuster comprising a stator and a rotor arranged coaxially to the stator, vanes of the rotor being pivotable by oil pressure in pressure chambers defined by radial walls of the stator.

BACKGROUND OF THE INVENTION

A generic vane-type adjuster of the pre-cited type is known from DE 196 23 818 A1. Here, too, the stator that is operatively connected to the crankshaft defines with its radially extending walls, pressure chambers in which the vanes of the rotor can be pivoted relative to the stator by oil pressure. This results in the desired angular adjustment of the camshaft relative to the crankshaft.

The stator and the rotor can be made by sinter pressing but due to the diameter and cross-section ratios, this is only possible with complicated and cost-intensive refinishing. In addition to this, appropriate oil channels have to be provided in the rotor for the actuation of the individual pressure chambers. These channels can either be formed integrally during the sintering operation or have to be made by subsequent machining. While the oil channels made during the sintering operation are situated on the lateral surfaces of the rotor and lead to a deterioration of sealing properties, the channels made by machining cause additional manufacturing work.

OBJECT OF THE INVENTION

The object of the invention is to reduce the work involved in the manufacture of a vane-type adjuster of a camshaft.

SUMMARY OF THE INVENTION

The invention achieves the above object with a device wherein the stator and the rotor are comprised respectively of a stack of stator blanks and a stack of rotor blanks, said blanks are made preferably by punching and are firmly connected to one another. The so-called punching and stacking technology used here originates from the field of construction of alternating current apparatuses where it serves to suppress eddy currents. Assembled camshafts with cams composed of identical blanks are also known.

In the device of the invention, the punching and stacking technology is used on hydraulic components of camshaft adjusters. The punching of the individual blanks and their firm connection to one another to form stacks are operations that can be automated and result in ready-to-be-installed components with a relatively small amount of fabrication work.

In an advantageous embodiment of the invention, the blanks have an identical outer contour but some of them have additional punched-out regions inside the outer contour and a defined position in the respective stack of blanks. Due to the identical outer contour of the individual blanks, the stack has the outer appearance of a homogeneous component. The blanks that have the additional punched-out regions inside the outer contour and are arranged in a defined position, form hollow inner spaces or channels that do not require any refinishing and do not cause any additional internal leakage.

Advantageously, particularly individual rotor blanks comprise either registering or offset, preferably radial punched-out regions which, when combined with rotor blanks without such regions, define laterally closed channels. In this way, the oil channels required for actuating the individual pressure chambers can be realized in the rotor with a small amount of work and with low leakage. The offset radial channels that are formed by the offset punched-out regions provided in a plurality of sheet metal layers enhance the stability and the shape quality of the individual blanks. Besides this, a greater flexibility in designing the oil channels is obtained that may be required in practical use.

In a further advantageous embodiment of the invention, the blanks comprise punched-out regions of identical shape, angular position and distance from the center and form an axial through-hole or, in combination with at least one blank without punched-out regions, they form at least one axial pocket hole. In this way, for example, the pocket bore required for a locking mechanism of the adjuster or a stepped central bore for the camshaft can be made in the rotor, and through-bores for tightening screws, in the stator.

It has proved to be of advantage to connect the blanks to one another, for example, by laser welding, stamping, gluing, countersunk riveting, countersunk screwing or by combinations of these joining methods. In this way, the stacks of blanks of the stator and the rotor become irreversibly joined components.

If registering punched recesses are made preferably on the outer contour of the blanks and laser welding is performed in the bottom region of these recesses, the weld zone is not affected by a possibly required post-machining.

In an advantageous embodiment of the invention, in place of countersinking a countersunk bore for countersunk head rivets, stepped punching is effected on at least two blanks on each side of the stator and the rotor, preferably with adjustable punching tools. This constitutes an inexpensive substitute for countersinking because no post-machining is required.

To obtain components with exact dimensions and achieve a good utilization of the sheet metal strip, it is advantageous to punch out the stator blanks and the rotor blanks in a coaxial arrangement out of a precision sheet metal strip. In this way, post-machining (e.g. grinding of height, outer and inner diameter) can be minimized or even eliminated. Due to the small thickness tolerances of the sheet metal strip, the punched and stacked parts have substantially the same quality as finished products. Strip thicknesses of 0.5 to 1.5 mm have the advantage that certain dimensions can be obtained by combining appropriate sheet thicknesses. Steel and aluminium have proved to be the most advantageous base materials for the sheet metal strips.

Oil leak tightness of the rotors and stators can be achieved by arranging flat seals between the individual blanks or by coating the blanks with a soft material. Without a sealing material between the blanks, the aforesaid joining methods result in the formation of fine fissures that can result in a certain amount of leakage. This can be desirable from the lubrication point of view.

Further features of the invention will become obvious from the following description of the drawings and from the drawings themselves in which one example of embodiment is schematically represented.

BRIEF DESCRIPTION OF THE DRAWINGS

The invention will now be described with reference to one example of embodiment. The attached drawings show.

DETAILED DESCRIPTION OF THE DRAWINGS

Figure 1:
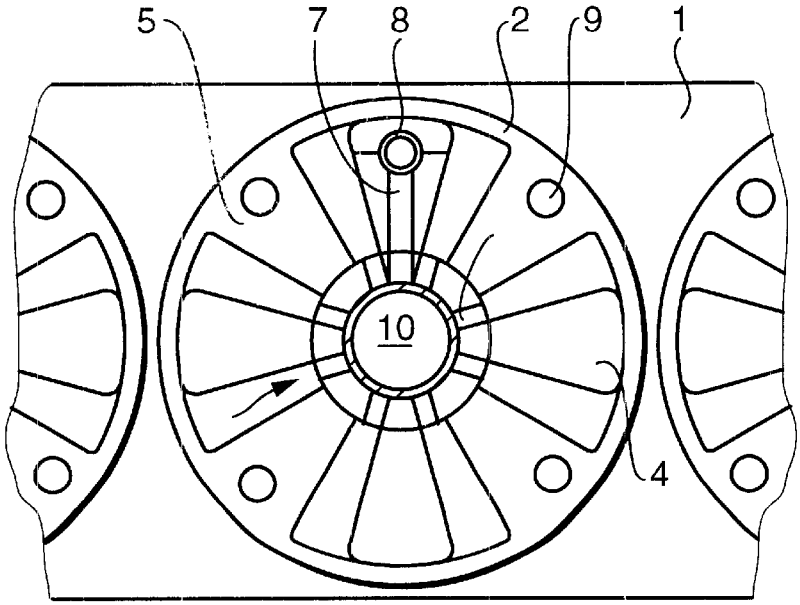
FIG. 1, a top view of a sheet metal strip with blanks of a stator and a rotor of a vane-type adjuster, with punched-out regions.

FIG. 1 shows a sheet metal strip 1 with the contours of a stator blank 2 and a rotor blank 3 of a vane-type adjuster. Both blanks 2 and 3 are arranged in their position of installation. The vane 4 of the rotor blank 3 is in a central position between the walls 5 of the stator blank 2.

This permits a maximum utilization of the surface of the sheet metal strip 1. Besides a central bore 10 for a camshaft, FIG. 1 also shows punched oil channels 6 of the rotor blank 3 that assure oil supply to the pressure chambers. A further oil channel 7 supplies pressure oil to a pocket bore 8 for a locking pin. The rotor blank 3 shown in this figure is therefore a blank from the central region of the stack of rotor blanks 3 which are covered laterally by rotor blanks without punched-out regions. The stator blank 2, in contrast, has a through-bore 9.

Figure 2:
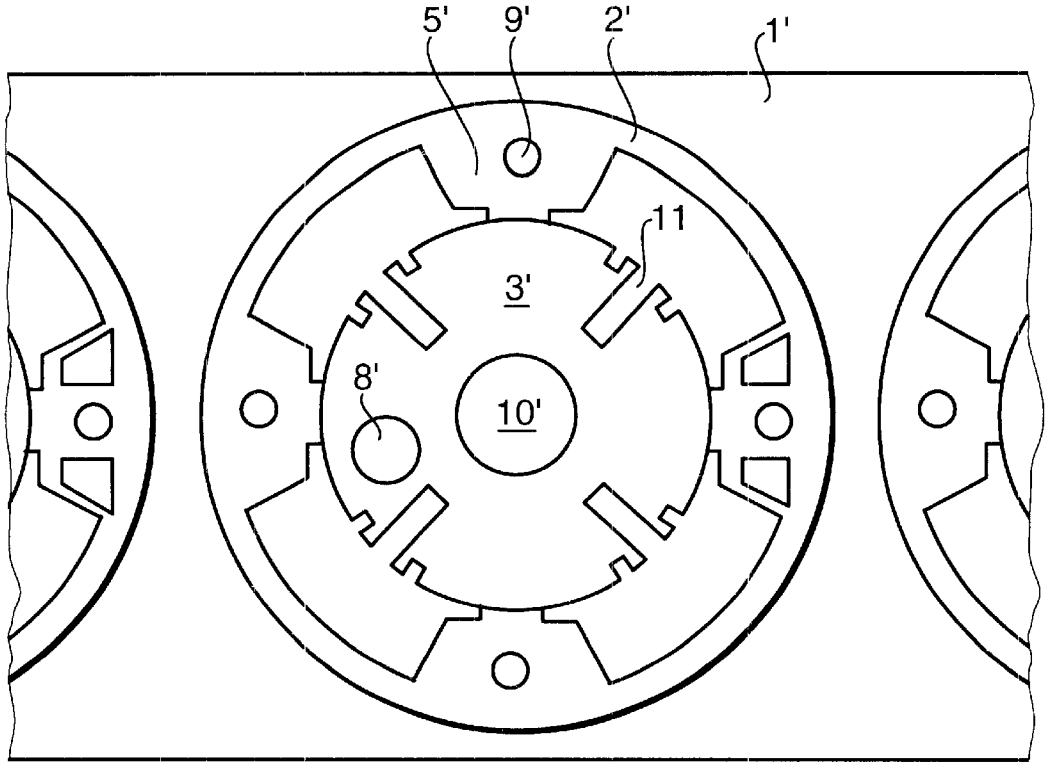
FIG. 2, a top view of a sheet metal strip with blanks of a stator and a rotor of another vane-type adjuster, with punched-out regions.

Similar to FIG. 1, FIG. 2 shows a sheet metal strip 1 with the contours of another stator blank 2' and another rotor blank 3' of another vane-type adjuster. Both these blanks 2' and 3' are likewise arranged in a place-saving installation position. Besides another pocket bore 8' and another central bore 10', the another rotor blank 3' also comprises four grooves 11 for the vanes of the another vane-type adjuster, that comprise the another stator blank 2' and other through-bores 9'.

Figure 3:
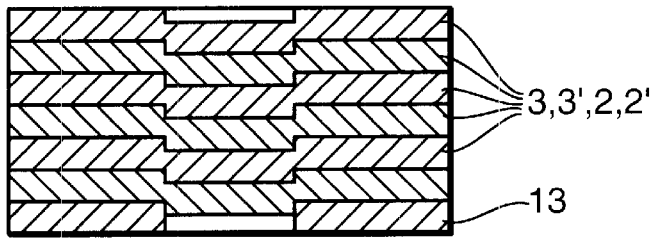
FIG. 3, a detail of astack of blanks joined by stamping.

FIG. 3 illustrates a stamped stack of blanks in which the individual blanks are joined to one another and to a bottom-most punched blank 13 by partial shearing deformation effected with a stamping die.

Figure 4:
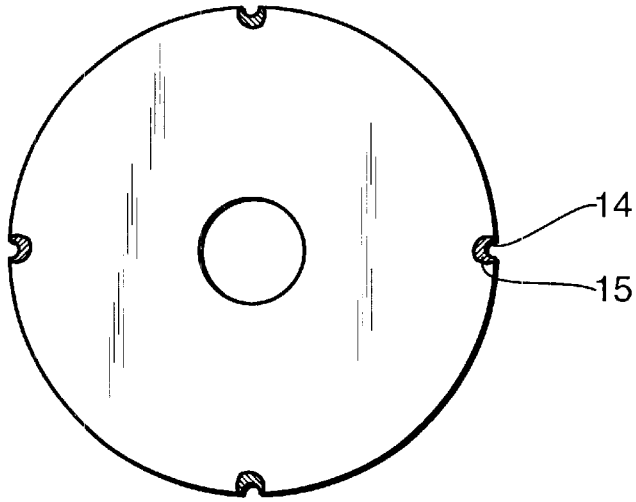
FIG. 4, a top view of a stack of blanks joined by laser welding, with registering punched recesses and laser weld zones.
Figure 4A:
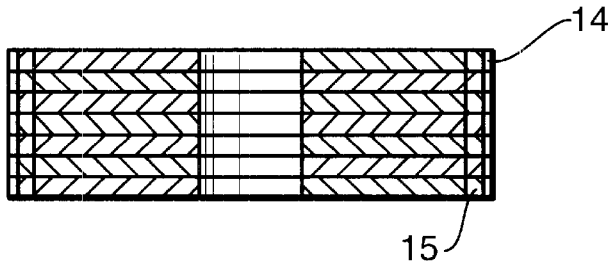
FIG. 4*a,* a cross-section through the center of the stack of blanks of FIG. 4, with the punched recesses and the laser weld zones.

FIGS. 4 and 4*a* show a stack of blanks which, on their outer contour, have punched recesses 14 in whose bottom region there is a weld zone 15 of the laser weld that joins the blanks firmly to one another. The depth of the punched recesses is chosen so that even a post-machining of the contour of the stack of blanks does not affect the weld zones 15.

Figure 5:
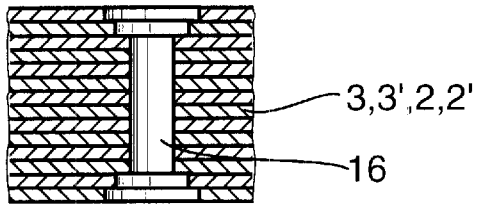
FIG. 5, a detail of a stack of blanks, with a countersunk rivet bore.

FIG. 5 shows a stack of blanks with a countersunk rivet bore 16 on both sides. "Countersinking" is effected by a stepped punching of two blanks on each side of the stack of blanks. This can be achieved with a single, adjustable punching tool.

Figure 6:
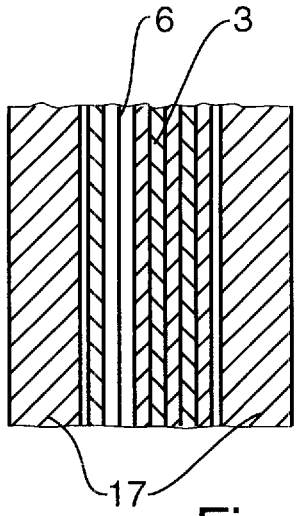
FIG. 6, a detail of a rotor cross-section, with an oil channel closed on all sides.

FIG. 6 shows a cross-section through a rotor with rotor blanks 3 that moves with play between two side elements 17 of a vane-type adjuster. Inside the rotor, there is an oil channel 6 formed by overlapping punched-out regions of two blanks that is laterally covered by the adjacent non-punched rotor blanks 3. In this way, additional inner oil leakage is prevented.

Figure 7:
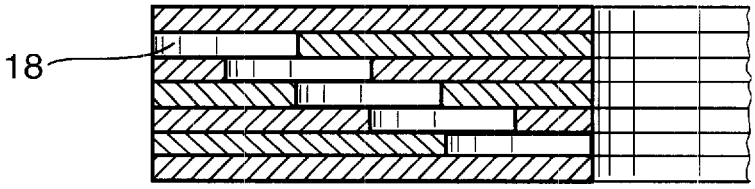
FIG. 7, a detail of a stack of blanks, with an offset oil channel.

An offset oil channel 18 is shown in FIG. 7 that is formed by punched-out regions in an offset arrangement to each other. This enhances the stability and the shape quality of the stack of blanks.

In addition to a minimization of costs and oil leakage, the fabrication of the rotor and the stator of a vane-type adjuster from sheet metal blanks offers the advantage of favorable wear properties. The reason for this lies in the high basic strength of the material and its shear hardening at the cut edges. An additional advantage is the high shape and dimensional precision of the punched and stacked parts. Besides this, the less than 100% bearing ratio resulting from the punching tear-out in each sheet metal layer has the advantage, in the case of sliding bearing surfaces, that lubricant pockets are formed.

LIST OF REFERENCE NUMERALS

1 Sheet metal strip
2 Stator blank
2' Another stator blank
3 Rotor blank
3' Another rotor blank
4 Vane
5 Wall
6 Oil channel
7 Another oil channel
8 Pocket bore
8' Another pocket bore
9 Through-bore
9' Another through-bore
10 Central bore
10' Another central bore
11 Groove
12 Stamped sheet metal
13 Punched blank
14 Punched recess
15 Weld zone
16 Countersunk rivet bore
17 Side element
18 Offset oil channel

What is claimed is:

1. A device for the angular adjustment of a camshaft relative to a crankshaft of an internal combustion piston engine, including a vane-type adjuster comprising a stator and a rotor arranged coaxially to the stator, vanes of the rotor being pivotable by oil pressure in pressure chambers defined by radial walls of the stator, characterized in that the stator and the rotor are comprised respectively of a stack of stator blanks (2, 2') and a stack of rotor blanks (3, 3'), said blanks are made by punching and are firmly connected to one another.

2. A device according to claim 1, characterized in that the blanks (2, 2', 3, 3') have an identical outer contour but some of the blanks have additional punched-out regions inside the outer contour and a defined position in the respective stack of blanks.

3. A device according to claim 2, characterized in that individual rotor blanks (3, 3') comprise either registering or offset, radial punched-out regions which, in combination with rotor blanks (3, 3') without such regions, define laterally closed channels (6).

4. A device according to claim 2, characterized in that the blanks (2, 2', 3, 3') comprise punched-out regions of identical shape, angular position and distance from the center and form an axial through-hole or, in combination with at least one blank (2, 2', 3, 3') without punched-out regions, they form at least one axial pocket hole.

5. A device according to claim 3, characterized in that the blanks (2, 2', 3, 3') are connected to one another by a method including laser welding, stamping, gluing, countersunk riveting, countersunk screwing or by combinations of these joining methods.

6. A device according to claim 5, characterized in that registering punched recesses (14) are made on the contour of the blanks (2, 2', 3, 3') and laser welding is performed in a bottom region of these recesses.

7. A device according to claim 6, characterized in that, in place of countersinking a countersunk bore (16), for countersunk head rivets, stepped punching is effected on at least two blanks (2, 2', 3, 3') on each side of the stator and the rotor, with adjustable punching tools.

8. A device according to claim 7, characterized in that the stator blanks (2, 2') and the rotor blanks (3, 3') are punched out in a coaxial arrangement out of a precision sheet metal strip (1).

9. A device according to claim 8, characterized in that flat seals are arranged between individual blanks (2, 2', 3, 3').

10. A device according to claim 9, characterized in that the blanks (2, 2', 3, 3') comprise a coating of a soft material.

* * * * *